US006508531B1

(12) United States Patent
Gargir

(10) Patent No.: US 6,508,531 B1
(45) Date of Patent: Jan. 21, 2003

(54) METHOD FOR REDUCING VARIATIONS IN PRINT DENSITY

(75) Inventor: Eyal Gargir, Kfar Saba (IL)

(73) Assignee: Aprion Digital Ltd., Netanya (IL)

( * ) Notice: Subject to any disclaimer, the term of this patent is extended or adjusted under 35 U.S.C. 154(b) by 0 days.

(21) Appl. No.: 10/043,107

(22) Filed: Jan. 14, 2002

(51) Int. Cl.[7] ..... B41J 2/01
(52) U.S. Cl. ..... 347/19
(58) Field of Search ..... 347/19; 400/74; 358/504, 406

(56) References Cited

U.S. PATENT DOCUMENTS 4,907,013 A 3/1990 Hubbard et al. ..... 347/19
5,528,270 A * 6/1996 Tajika et al. ..... 347/19
5,552,810 A 9/1996 Matsuo ..... 347/19
5,798,773 A 8/1998 Hiramatsu et al. ..... 347/19
6,273,542 B1 * 8/2001 Couwenhoven et al. ..... 347/19

* cited by examiner

*Primary Examiner*—Craig Hallacher
(74) *Attorney, Agent, or Firm*—Mark M. Friedman

(57) ABSTRACT

A method for reducing undesired variations of print density in a printed output is implemented by selectively increasing the number of drops of ink deposited in rows traveled by nozzles corresponding to a reduced-output region of the print head compared to the pattern of drops which would be deposited if all nozzles were operating normally.

5 Claims, 10 Drawing Sheets

FIG. 5A
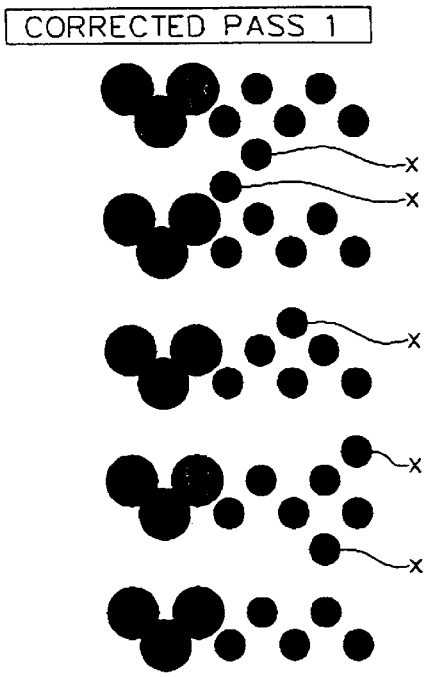
FIG. 5B
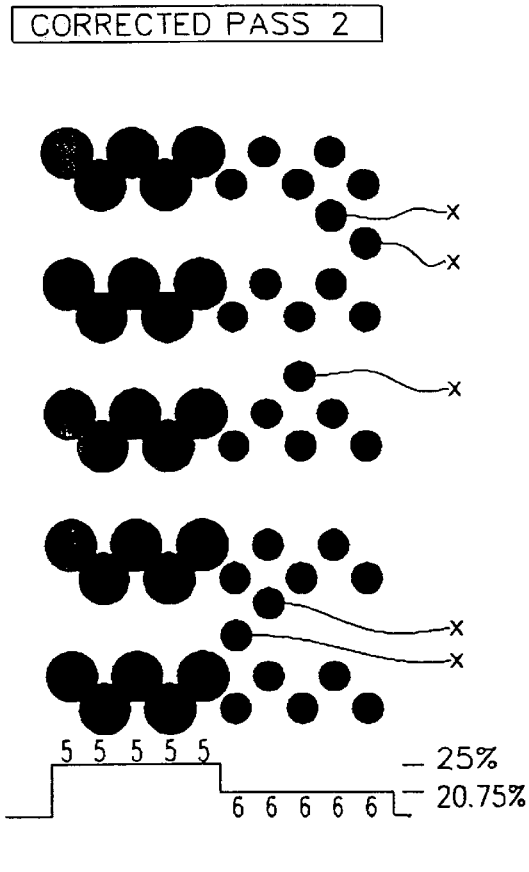
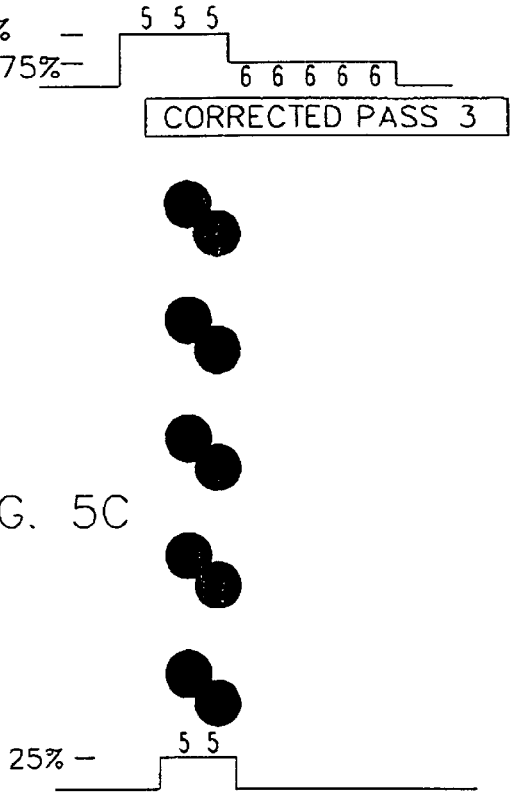
FIG. 5C

FIG. 10A

| | | |
|---|---|---|
| 113 | 226 | 56 |
| 255 | 28 | 170 |
| 85 | 198 | 141 |

FIG. 10B

| | | |
|---|---|---|
| 113 | 226 | 46 |
| 255 | 28 | 170 |
| 85 | 198 | 117 |

Modified values

METHOD FOR REDUCING VARIATIONS IN PRINT DENSITY

FIELD AND BACKGROUND OF THE INVENTION

The present invention relates to the field of printing and, in particular, it concerns a method for reducing variations in print density particularly suitable for use in inkjet printers.

It is known that output from inkjet printers often suffers from problems of non-uniform print density. In other words, regions of the output which are intended to appear a uniform shade actually exhibit variations in shade. This is caused by a number of factors including: lack of uniformity of drop size fired by different nozzles of the print head, and varying precision of drop position from different nozzles which result in uneven coverage of the substrate.

Any problem of non-uniformity of the printed output which is caused by features of the print head will appear in the printed output as a regular pattern corresponding to the movements of the print head over the substrate. One well known technique for reducing the visibility of these cyclic variations is multi-pass printing in which the print head passes over each region of the substrate to be printed two or more times with overlapping swaths. Although this technique tends to attenuate the variations and increases the spatial frequency of the variations, it does not achieve uniformity of output.

A number of approaches have been proposed for providing print quality feedback to modify operation of a print head. Of most relevance to the present invention is U.S. Pat. No. 5,798,773 to Hiramatsu et al. which discloses an apparatus and method for correction of density unevenness. The apparatus employs a reader to identify unevenness in a printed calibration pattern and then performs an unevenness correction. This correction is described as being implemented "by correcting the drive signal (signal duration or voltage) of the required nozzles of the recording head" (column 5, lines 24–26), thereby varying the size of drops ejected by the inkjet nozzles in selected locations.

While the approach of Hiramatsu et al. is theoretically correct, implementation of this approach is in most cases complicated and over costly. Specifically, a typical inkjet printer has thousands, and often tens of thousands, of nozzles operating simultaneously. The hardware requirements to enable selective adjustment of either the actuating voltage or the pulse duration for individual nozzles are typically prohibitively expensive.

There is therefore a need for a method for reducing variations in print density which would at least partially compensate for unevenness of output from a print head without requiring the complicated hardware modifications required by the Hiramatsu et al. technique.

SUMMARY OF THE INVENTION

The present invention is a method for reducing variations in output print density from an inkjet printer.

According to the teachings of the present invention there is provided, a method for reducing variations in print density in a printed output on a substrate resulting from defective nozzles of a print head, the method comprising: (a) obtaining a print density distribution for at least part of the print head, the print density distribution being indicative of at least one region of reduced print density due to defective nozzles; (b) assigning output reduction factors between 1% and 99% to a plurality of nozzles which are positioned within the print head so as to contribute to print density within the at least one region; (c) receiving data corresponding to an image to be printed; and (d) applying drops of ink to the substrate while passing the print head over the substrate, wherein numbers of ink drops applied to the substrate along lines traveled by each of the plurality of nozzles are increased as a function of a corresponding one of the output reduction factors.

According to a further feature of the present invention, each of the output reduction factors is generated as a function of print density over a region covered by a plurality of nozzles.

According to a further feature of the present invention, each of the output reduction factors is generated as a function of print density as measured by scanning a sample output at a resolution lower than the printing resolution of the print head.

According to a further feature of the present invention, the numbers of drops are increased by printing selected dots along the lines twice using two distinct nozzles during two passes of the print head.

According to a further feature of the present invention, the numbers of drops are increased by modifying screen values in a portion of a screen associated with locations to be printed by the plurality of nozzles.

BRIEF DESCRIPTION OF THE DRAWINGS

The invention is herein described, by way of example only, with reference to the accompanying drawings, wherein:

FIGS. 5A, 5B and 5C are schematic representations of partial printed outputs produced by the print head of FIG. 2 actuated according to the teachings of the present invention to print the pattern of FIG. 1 in a two-pass system;

FIGS. 10A and 10B are schematic representations of screen value matrices for a group of normally functioning nozzles and for a group including reduced output nozzles according to the implementation of FIG. 9.

DESCRIPTION OF THE PREFERRED EMBODIMENTS

The present invention is a method for reducing variations in output print density from an inkjet printer.

The principles and operation of methods according to the present invention may be better understood with reference to the drawings and the accompanying description.

Figure 1:
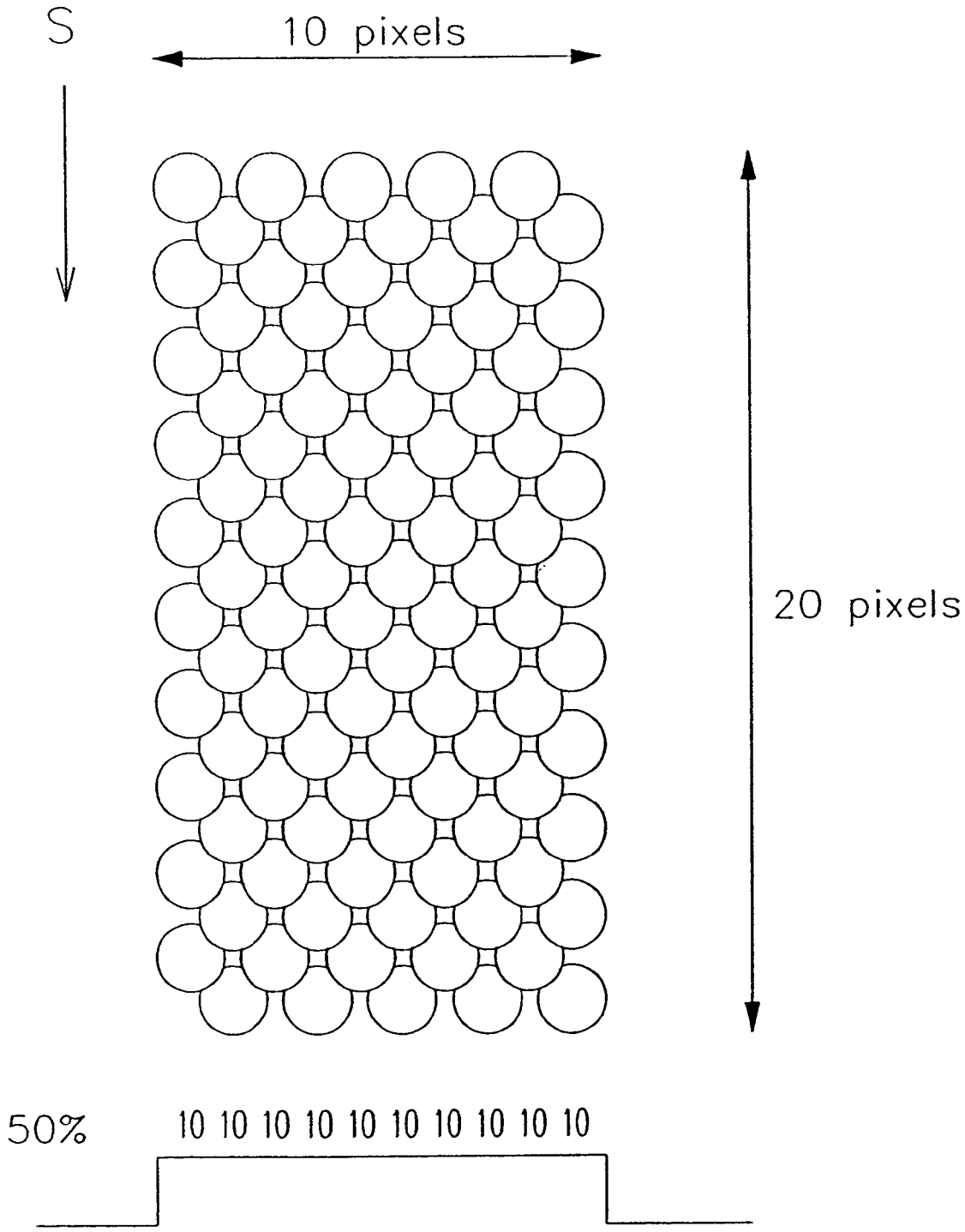
FIG. 1 is a schematic representation of an idealized printed output of uniform 50% print density which will be used to illustrate the principles of the present invention.

Before addressing the invention itself, it will be useful to refer briefly to FIGS. 1–4 which describe a schematic example of the problem to which the invention relates. Specifically, for the purpose of illustration, reference will be made to a case in which a printed output of uniform 50% print density is desired. An idealized representation of the desired output is shown in FIG. 1. The illustrated pattern is assumed to be produced by a line of 10 nozzles passing in a scanning direction S. Each nozzle ejects a drop at alternate pixel positions such that, in the illustrated region of 20 pixels length, each nozzle prints 10 dots. The resultant printed density, when all nozzles are working properly, is considered to be 50% nominal coverage.

Figure 2:
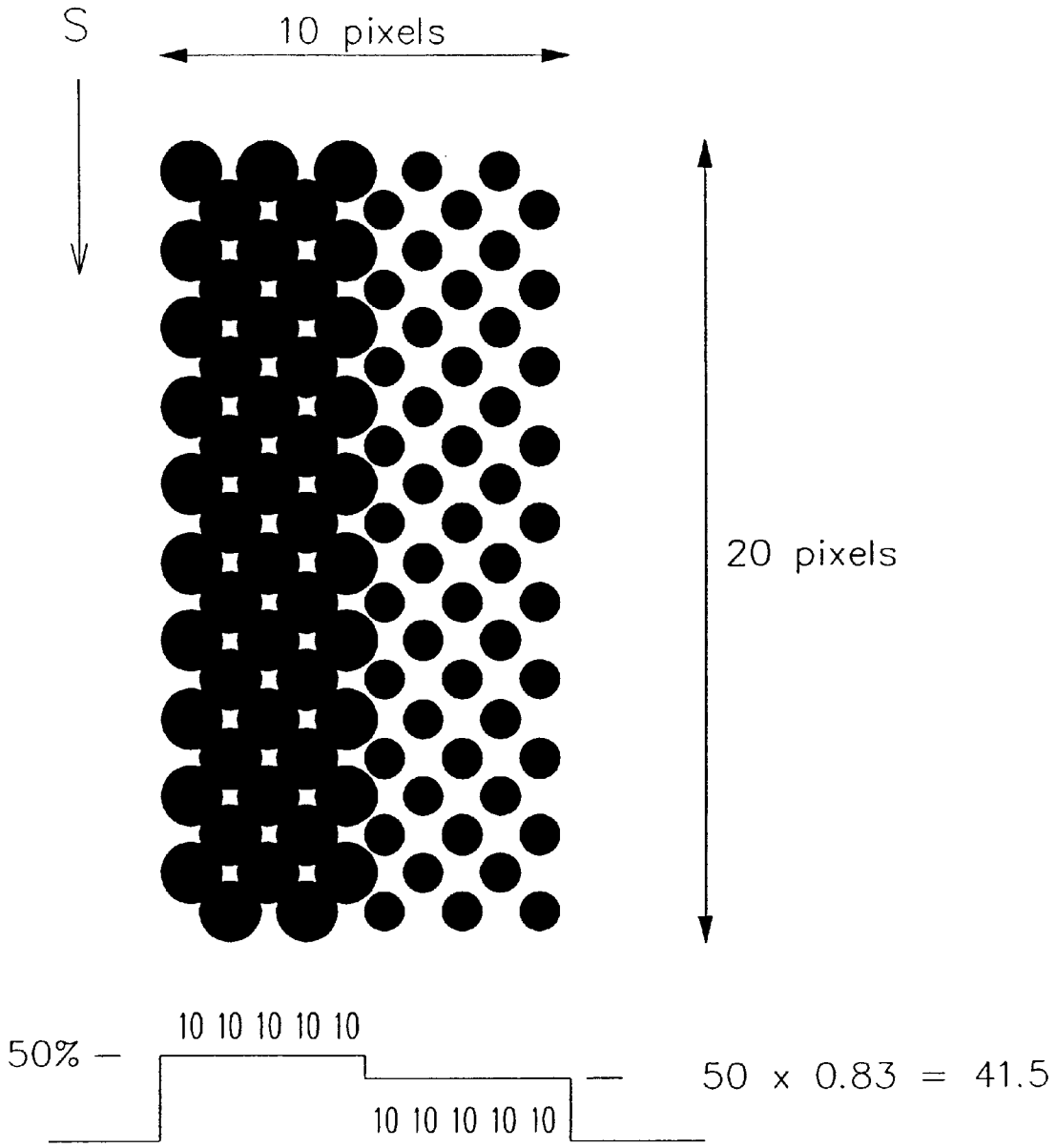
FIG. 2 is a schematic representation of an actual output produced by an imperfect print head on attempting to print the pattern of FIG. 1 in a single pass.
Figure 3A:
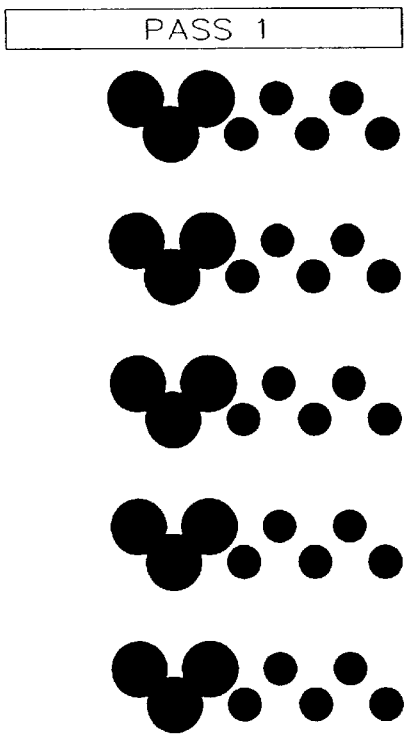
FIGS. 3A, 3B and 3C are schematic representations of partial printed outputs produced by the print head of FIG. 2 on attempting to print the pattern of FIG. 1 in a two-pass system.
Figure 3B:
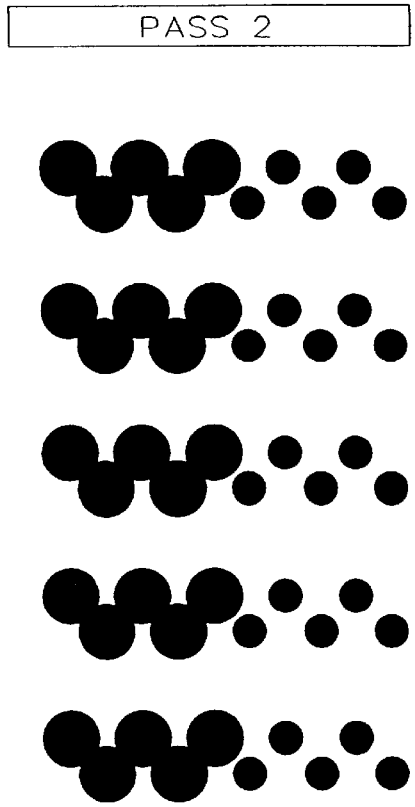
Figure 3C:
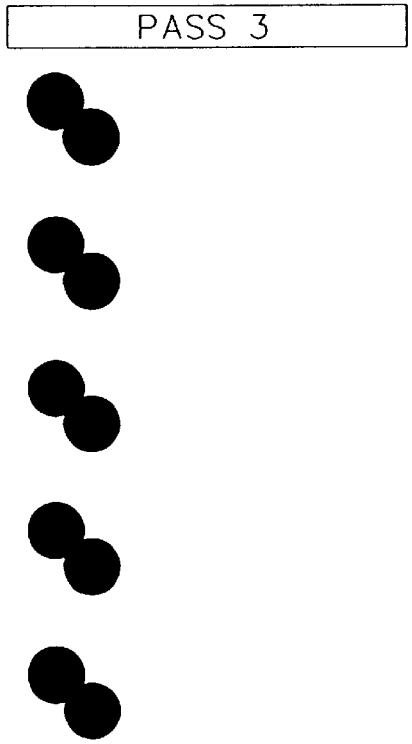
Figure 4:
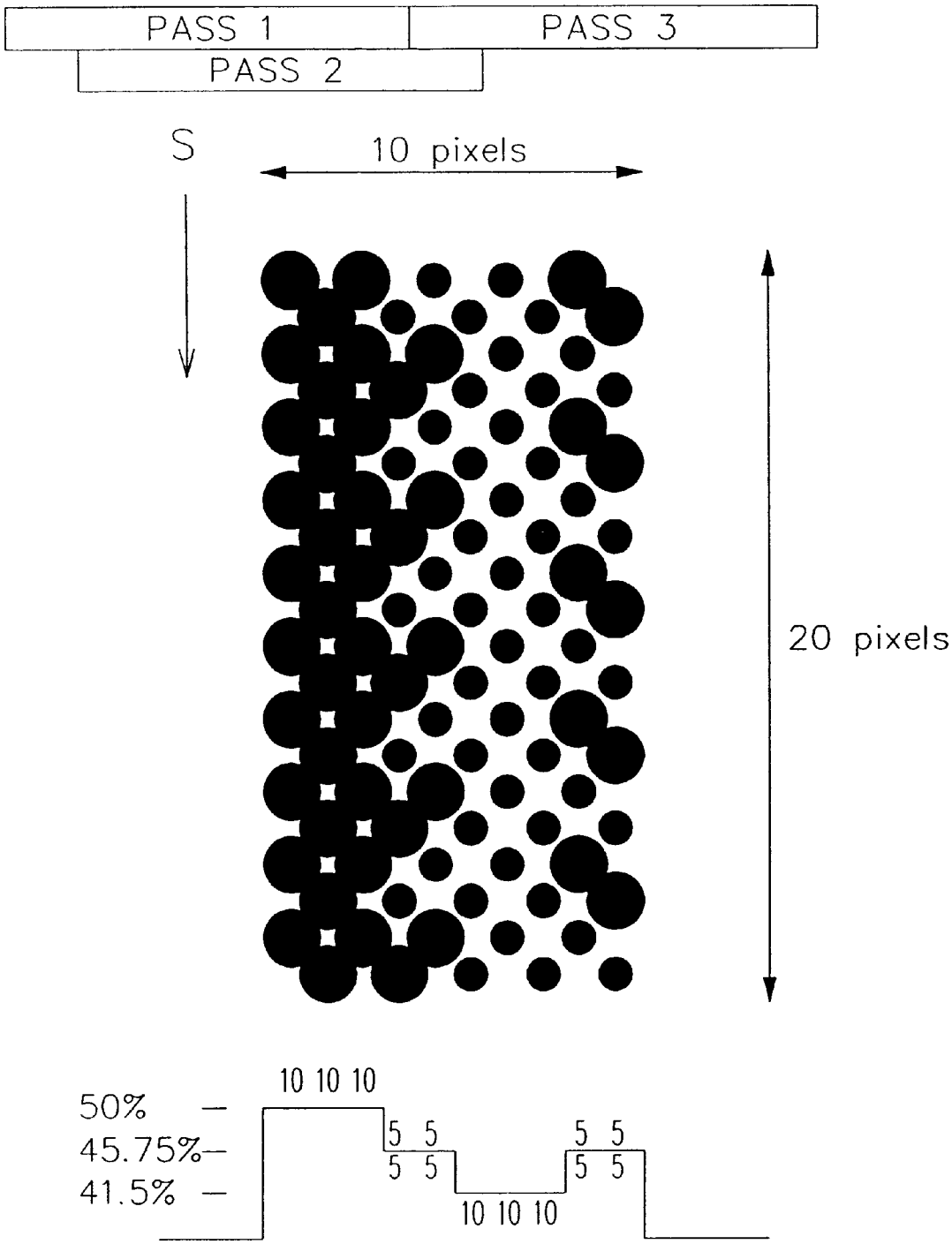
FIG. 4 is a schematic representation of the cumulative effect of the outputs of FIGS. 3A, 3B and 3C.
Figure 6:
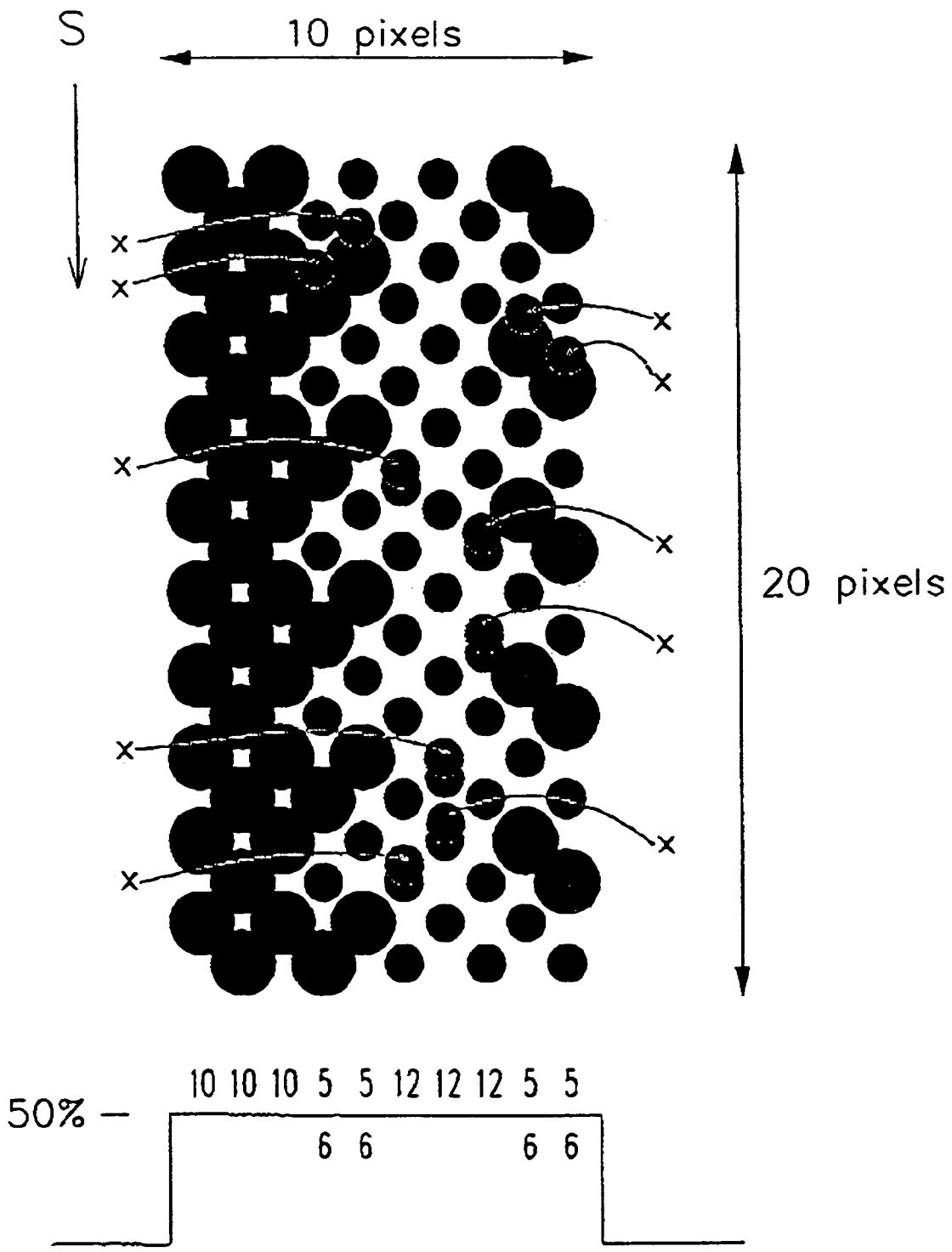
FIG. 6 is a schematic representation of the cumulative effect of the outputs of FIGS. 5A, 5B and 5C.

At the base of this figure, as well as in FIGS. 2, 4 and 6, there is shown a schematic representation of the print density distribution. In each case, the percentage value for a given row is the sum of the drop sizes relative to the theoretical maximum of 20 full size drops. Thus, a row of 10 normal drops is defined as a nominal print density of 50%. If each drop of a given row is reduced by 17%, the percentage drops to $(10\times0.83)/20=41.5\%$, as will be discussed below with reference to FIG. 2.

FIG. 2 illustrates the results of an attempt to print the pattern of FIG. 1 with an imperfect print head in which the five nozzles responsible for printing the five rows on the left-hand-side of the figure are operating properly and the five nozzles responsible for printing the five rows on the right-hand-side of the figure are producing a reduced output. Specifically, if the defective nozzles are each producing a drop 17% smaller than the normal drop size, the resultant print density on the right side of the output may be assumed to be approximately 0.83 of the intended 50% density, namely 41.5%. The result would be clear bands of reduced density in the printed output.

FIGS. 3A–3C and 4 show the results of printing with the same print head in two passes with a two-pixel offset. The first pass, shown in FIG. 3A, prints half the data for 8 rows in the region of interest (as well as 2 rows outside to the left which are not shown). Of these, three rows print regular size drops and five print small drops. Each row prints alternate drops of the 50% pattern of FIG. 1 (i.e., one drop every four pixels). The second pass, shown in FIG. 3B, prints half the data for all 10 rows, five using regular drops and five using small drops. The third pass, shown in FIG. 3C, prints the remaining half of the data for the last two rows using regular size drops.

FIG. 4 shows the cumulative effect of these outputs. Referring to the rows by numbers 1–10 from left to right, rows 1–3 have each received their full quota of 10 regular size drops, rows 4, 5, 9 and 10 have received 5 regular drops and 5 small drops, and rows 6–8 have received 10 small drops. The result is a somewhat smoothed variation of printed density, but with the same range of variation from the intended 50% down to 41.5% and consequent degradation of the printed output.

Turning now to the teachings of the present invention, in its most general form, the invention provides a method for reducing undesired variations of print density in a printed output by selectively increasing the number of drops of ink deposited in rows traveled by nozzles corresponding to a reduced-output region of the print head compared to the pattern of drops which would be deposited if all nozzles were operating normally.

The approach of the present invention is represented schematic in FIGS. 5A–5C and 6. Specifically, by comparing FIGS. 5A and 5B with FIGS. 3A and 3B, respectively, it will be noted that a number of additional drops X have been deposited in rows printed by the reduced-output nozzles. In this case, each row printed by a reduced-output nozzle has one additional small drop added for each 5 small drops printed. FIG. 6 shows the resulting overall print density in which rows 1–3 have 10 regular drops, rows 4, 5, 9 and 10 have 5 regular drops and 6 small drops, and rows 6–8 have 12 small drops. The overall result is a substantially uniform 50% coverage which, when viewed from a normal viewing distance, closely approximates to the visual effect of the ideal pattern of FIG. 1.

It will be apparent to one skilled in the art that care must be taken when implementing the present invention in order to avoid corruption of the printed information. Specifically, the additional drops must not unduly darken regions of the output which are meant to be light, and they must be distributed in a dispersed and non-periodic manner so as to avoid generating unwanted artifacts. A number of specific preferred implementations will now be described with reference to FIGS. 7–10. It should be appreciated, however, that the invention in its most general form is not limited to these specific examples and may be implemented in numerous other forms, as will be clear to one ordinarily skilled in the art.

Figure 7:
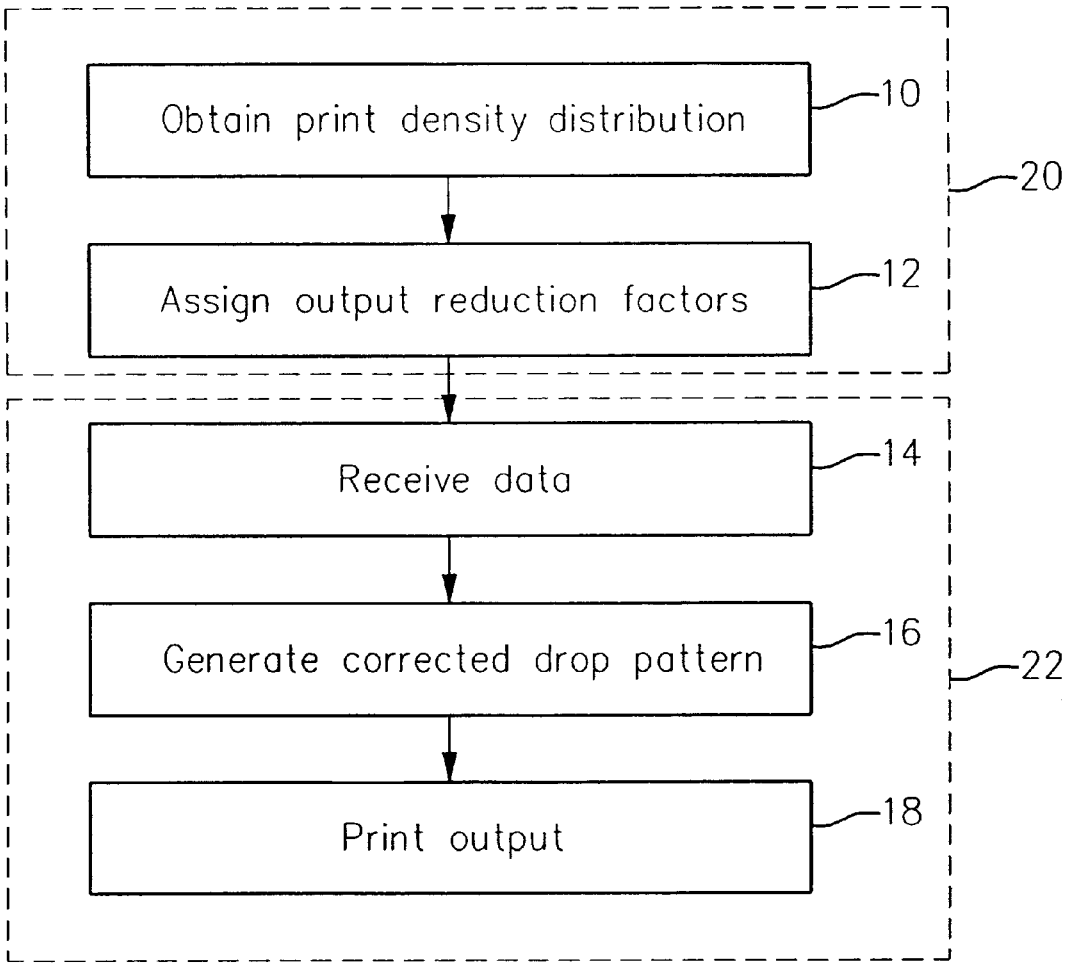
FIG. 7 is a flow diagram illustrating a first preferred implementation of the method of the present invention.

Turning now to FIG. 7, this illustrates a first preferred implementation of a method according to the present invention for reducing variations in print density in a printed output on a substrate resulting from defective nozzles of a print head. Generally speaking, the method includes obtaining a print density distribution for at least part of the print head which is indicative of at least one region of reduced print density due to defective nozzles (step 10) and assigning output reduction factors between 1% and 99% to a plurality of nozzles which are positioned within the print head so as to contribute to print density within the region of reduced print density (step 12). After receiving data corresponding to an image to be printed (step 14), the method then applies drops of ink to the substrate while passing the print head over the substrate (step 18) in such a manner as to ensure that numbers of ink drops applied to the substrate along lines traveled by each of the nozzles are increased as a function of the corresponding output reduction factor. In the implementation shown here, the drop distribution is allocated in a step 16 at which a "corrected drop pattern" is generated.

It will be readily appreciated that the present invention offers a highly advantageous solution to the problem of uneven print density. By adding extra drops, it is possible to compensate partially or fully for regions of reduced density output from malfunctioning inkjet nozzles. At the same time, by employing additional discrete dots, the need for nozzle-by-nozzle adjustment of the actuating voltage or pulse duration is avoided, thereby rendering the methods of the present invention easier to implement than the techniques of the Hiramatsu et al. reference discussed above. This and other advantages of the present invention will become clearer from the following description.

Turning now to the features of the method of FIG. 7 in more detail, it will be appreciated that steps 10 and 12 may be regarded as part of a setup or maintenance procedure 20 which may be performed intermittently on demand, or may be automated to be performed on a regular basis. The remaining steps 14, 16 and 18 are here shown as part of a printing procedure 22 which is performed each time data is received for printing. It should be noted, however, that this subdivision is not absolute. For example, as will be discussed below, certain hardware implementation of the drop pattern correction may enable much of the correction to be performed as part of the setup procedure 20.

The specific technique used for obtaining the print density distribution and determining appropriate output reduction factors is not generally critical to the present invention. Most preferably, regions of reduced print density are identified, and the corresponding reduction factors quantified, by optical scanning and subsequent analysis of a sample printed output from the print head. In this context, it should be noted that the output reduction factor is an indication of the correction required, and is not necessarily set solely according to the quantity of ink ejected in each drop. For example, a misalignment of a nozzle may cause displacement of a drop so as to overlie an adjacent drop such that a proportion of the pixel to be printed by that nozzle always remains empty. This may result in an apparent "low density" region in the output despite the fact that the correct quantity of ink was actually delivered.

It should be noted that the correction factors of the present invention are preferably generated as a function of print density over a region covered by a plurality of nozzles. In other words, correction is performed as a function of the overall print density effect in the corresponding region of the output without any need to determine which specific nozzles within that region are responsible for the print density reduction. One approach to achieving this result is by scanning a sample output at a resolution lower than the printing resolution of the print head. This may inherently ensure that corrections are made on the basis of variations on a scale visible to the eye. Clearly, a similar result may be achieved by numerical techniques such as by smoothing (e.g. by a rolling average) print density measurements scanned at a high resolution.

Reference is made herein to output reduction factors taking values between 1% and 99%. Clearly, a reduction of 0% corresponds to a nozzle in a region which is fully functional. A reduction factor of 100% would indicate a region containing a number of completely inoperative nozzles. The issue of inoperative nozzles is addressed by various other systems known in the art, and is not directly addressed per se by the present invention. Clearly, the present invention may optionally be implemented to advantage in combination with a system for clearing blocked nozzles.

Although the correction factor is referred to herein as an "output reduction factor" it will be readily appreciated that the factor may be equivalently expressed in various different forms, including as a correction factor which is the reciprocal of the "reduction factor". All such numerical manipulations should be clearly understood to fall within the scope of the "output reduction factor" terminology. Furthermore, any numerical factor which facilitates performance of a correction according to the teachings of the present invention will clearly be understood to be an equivalent of the recited factor.

Figure 8:
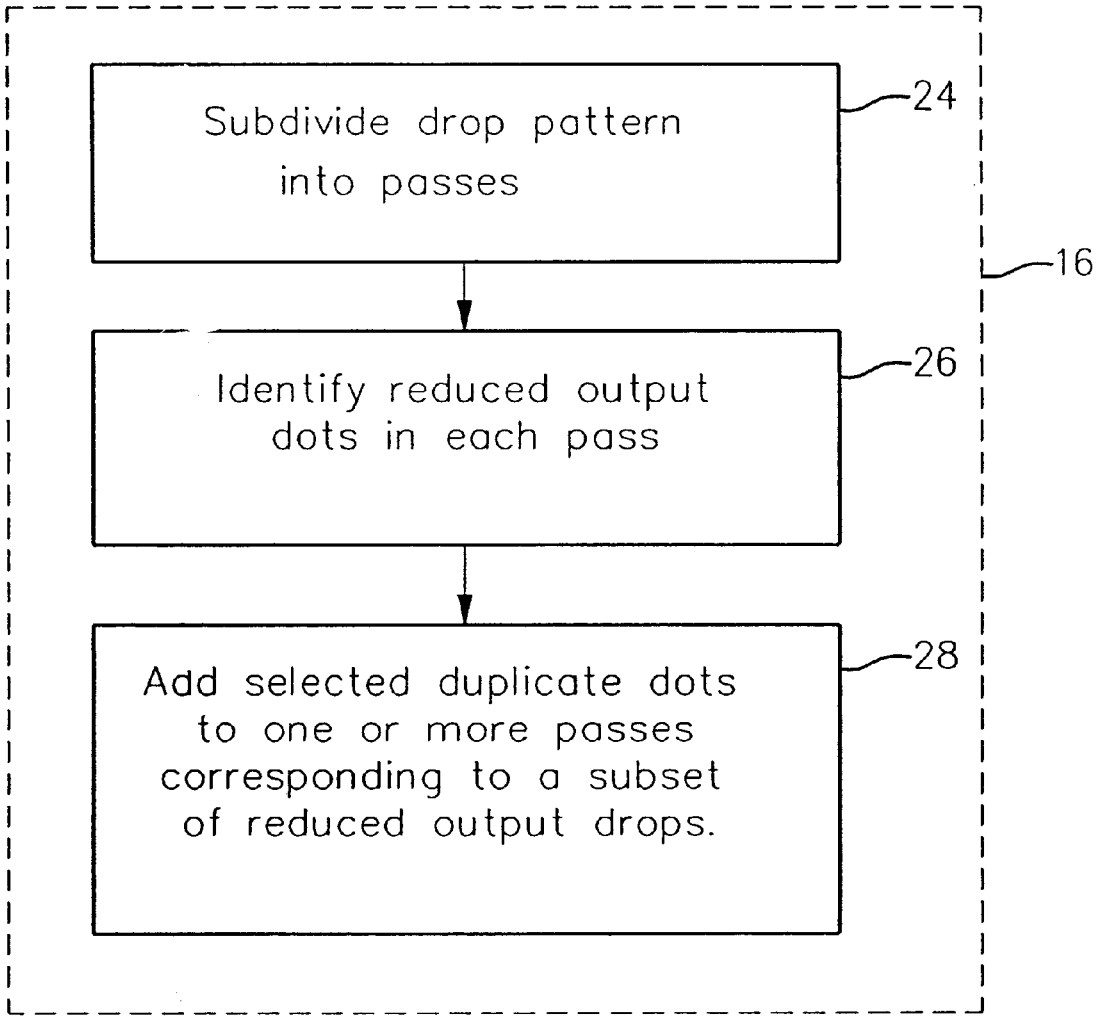
FIG. 8 is a detailed flow diagram illustrating a first implementation of a step for generating a corrected drop pattern from FIG. 7.

Turning now to FIG. 8, this shows a particularly preferred implementation of step 16 for generating a "corrected drop pattern" in the case of a multiple-pass printer (i.e., in which printing is performed in two or more passes). Firstly, at step 24, the received image data is processed, typically in a conventional manner, to generate driver information corresponding to which dots are to be generated during which pass of the print head. Then, at step 26, the dots to be printed by nozzles corresponding to reduced print density regions in each pass are identified. Data is then added to the driver information at step 28 to designate selected dots to be printed in duplicate during at least one other pass of the print head. In other words, a proportion of the dots to be printed by each nozzle with a non-zero reduction factor are printed at least twice, thereby increasing the darkness and/or coverage for those dots. Optionally, certain dots may be printed more than two times. The proportion of reduced density dots duplicated is chosen according to the density reduction factor so as to provide as near as possible to optimal compensation in the overall printed image.

The specific implementation of FIG. 8 offers a number of significant advantages. Firstly, since every dot is printed in the location in which a dot was anyway meant to be in the "ideal" output, corruption of the printed output is avoided. Secondly, this approach offers very wide dynamic range up to approaching twice the "normal" printed output, thereby allowing correction of relatively severe density irregularities. Finally, this approach may be implemented primarily through software with no modification of the hardware for driving the print head.

Figure 9:
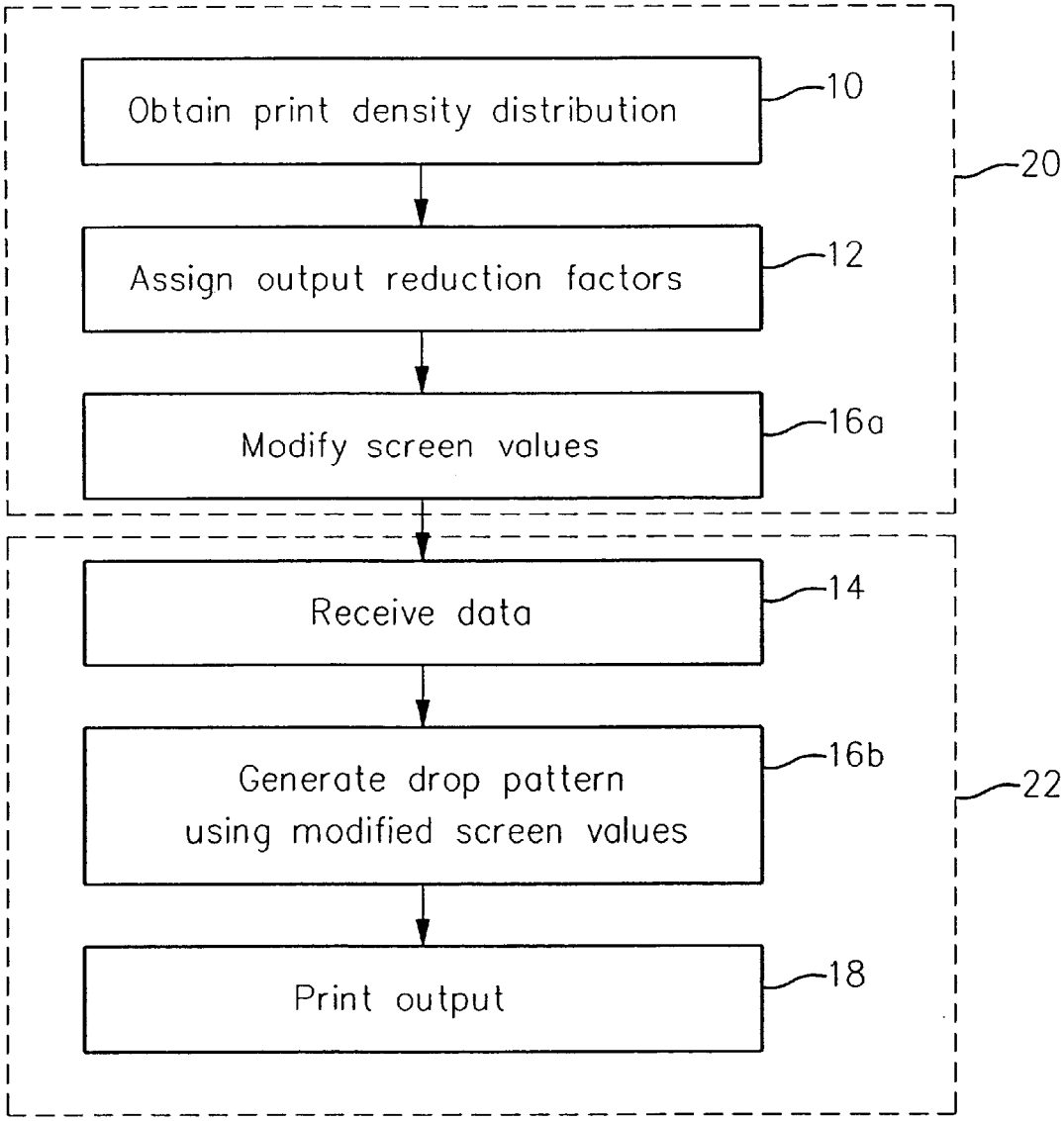
FIG. 9 is a flow diagram similar to FIG. 7 modified to illustrate a second implementation of the present invention.

Turning now to FIGS. 9, 10A and 10B, these illustrate an alternative preferred implementation of the method of the present invention in which the numbers of drops is increased by selectively modifying screen values in a portion of a screen associated with locations to be printed by the defective nozzle.

To illustrate this approach, FIG. 10A illustrates schematically 3×3 screen element which can be applied to groups of 9 pixels each taking a values between 0 and 255 to generate 10 levels of output density. In the standard screen element of FIG. 10A, the values are evenly dispersed as 28, 56, 85, 113 etc.

FIG. 10B shows a similar screen element modified according to the present invention for a case in which the pixels corresponding to the right-hand column of the screen element are to be printed by a nozzle or nozzles designated as a defective nozzle group with a output reduction factor of 17%. In order to compensate for the reduced output along this line, the screen values of the corresponding column are reduced by 0.83, thereby correspondingly increasing the number of dots to be printed along the lines traveled by the defective nozzle group.

It will be noted that this approach can only be applied when the screen is directly associated with specific nozzles of the print head. As a result, this approach is typically most suited for hardware implementation where the screen has selectively re-programmable values. In this case, step 16 of FIG. 7 is effectively subdivided as shown in FIG. 9 into a setup procedure 16*a* in which the appropriate screen values are modified and a calculation step 16*b* which is essentially the standard screening procedure but performed with the modified screen values.

The modified screen value approach has one notable advantage over the implementation of FIG. 8 in that it can be used even with single-pass printing. A notable disadvantage is the limited dynamic range of the correction since the maximum achievable density is not enhanced by this approach.

Although the invention has been illustrated with reference to two preferred examples, it should be noted that the invention is not limited to these examples. Thus, for instance, the increased number of dots could optionally be achieved by providing additional firing pulses to selectively "double-up" a dot. This approach would take advantage of the capability of inkjet nozzles to intermittently fire two drops in quick succession at a frequency greater than the normal repeat frequency. This approach would also be possible in single-pass printing.

It will be appreciated that the above descriptions are intended only to serve as examples, and that many other embodiments are possible within the spirit and the scope of the present invention.

What is claimed is:

1. A method for reducing variations in print density in a printed output on a substrate resulting from defective nozzles of a print head, the method comprising:

(a) obtaining a print density distribution for at least part of the print head, said print density distribution being indicative of at least one region of reduced print density due to defective nozzles;

(b) assigning output reduction factors between 1% and 99% to a plurality of nozzles which are positioned within the print head so as to contribute to print density within said at least one region;

(c) receiving data corresponding to an image to be printed; and (d) applying drops of ink to the substrate while passing the print head over the substrate, wherein numbers of ink drops applied to said substrate along lines traveled by each of said plurality of nozzles are increased as a function of a corresponding one of said output reduction factors.

2. The method of claim 1, wherein each of said output reduction factors is generated as a function of print density over a region covered by a plurality of nozzles.

3. The method of claim 1, wherein each of said output reduction factors is generated as a function of print density as measured by scanning a sample output at a resolution lower than the printing resolution of the print head.

4. The method of claim 1, wherein said numbers of drops are increased by printing selected dots along said lines twice using two distinct nozzles during two passes of said print head.

5. The method of claim 1, wherein said numbers of drops are increased by modifying screen values in a portion of a screen associated with locations to be printed by said plurality of nozzles.

* * * * *